US009616556B2

(12) United States Patent
Kauffman

(10) Patent No.: US 9,616,556 B2
(45) Date of Patent: Apr. 11, 2017

(54) UNIVERSAL SELF-ADJUSTING, OPEN-ENDED POWERED WRENCH

(71) Applicant: Robert Gregory Kauffman, Reno, NV (US)

(72) Inventor: Robert Gregory Kauffman, Reno, NV (US)

( * ) Notice: Subject to any disclaimer, the term of this patent is extended or adjusted under 35 U.S.C. 154(b) by 531 days.

(21) Appl. No.: 14/031,043

(22) Filed: Sep. 19, 2013

(65) Prior Publication Data

US 2014/0083255 A1 Mar. 27, 2014

Related U.S. Application Data

(60) Provisional application No. 61/704,478, filed on Sep. 22, 2012.

(51) Int. Cl.
*B25B 21/00* (2006.01)
*B25B 17/00* (2006.01)

(52) U.S. Cl.
CPC ..... *B25B 21/00* (2013.01); *B25B 17/00* (2013.01); *B25B 21/002* (2013.01)

(58) Field of Classification Search
CPC ..... B25B 17/00; B25B 21/00; B25B 17/02; B25B 21/002; B25B 21/004; B25B 15/04; B25B 13/467; B25B 13/48; B25B 15/02
See application file for complete search history.

(56) References Cited

U.S. PATENT DOCUMENTS 3,023,651 A * 3/1962 Wallace ..... E21B 19/164 81/57.18
5,000,065 A * 3/1991 Haynes ..... E21B 19/164 279/64
6,829,967 B1 * 12/2004 Kemp ..... E21B 19/164 81/57.14
7,013,759 B1 * 3/2006 Childress, II ..... E21B 19/163 74/422
7,013,764 B2 * 3/2006 Leatherby ..... B25B 13/5083 81/176.15
2012/0103142 A1 * 5/2012 Sroka ..... B25B 13/48 81/57.11
2013/0025416 A1 * 1/2013 Dedrickson ..... B25B 21/004 81/57.11

* cited by examiner

*Primary Examiner* — Robert Scruggs

(57) ABSTRACT

Examples disclosed herein relate to one or more wrench devices. An apparatus may include a drive gear assembly configured to be coupled to a power source. The drive gear assembly may include a plurality of drive gears. The apparatus may include a cam assembly coupled to the drive gear assembly. The cam assembly may include a first cam and a second cam. Further, the first cam and the second cam may be configured to interact with each other to move a part.

17 Claims, 16 Drawing Sheets

CLOSED

300

SEVERAL ITEMS
HIDDEN FOR
CLARITY

OPEN

301

SEVERAL ITEMS
HIDDEN FOR
CLARITY 122
156
124

122
154
126
152

400

106C
122
130
136
114
104B
120B
118
120A
106C
106B
103
106A
110
108
104A

COURSE DIAMOND KNURLED SURFACE APPLIED BEFORE HEAT TREAT FOR GRIP ON BOLT HEAD.

UNIVERSAL SELF-ADJUSTING, OPEN-ENDED POWERED WRENCH

CROSS-REFERENCE TO RELATED PATENT APPLICATION

This patent application claims priority to Provisional Patent Application No. 61/704,478 entitled "UNIVERSAL SELF-ADJUSTING, OPEN-ENDED POWERED WRENCH", filed on Sep. 22, 2012, which is incorporated herein by reference in its entirety.

FIELD

The subject matter disclosed herein relates to a self-adjusting and open-ended wrench. More specifically, the disclosure relates to a powered wrench that may be utilized with a universal adaptor.

INFORMATION

In the construction, maintenance, and repair fields, inserting and removing (and/or tightening and/or loosening) a part may be difficult for numerous reasons. In some cases, the part is in a location which makes it difficult to reach the part with a standard wrench and/or another device. In other cases, obtaining a proper grip on the part may be difficult to achieve which may cause undue wear and tear. This disclosure mitigates these concerns along with providing other benefits which will be described in this disclosure.

BRIEF DESCRIPTION OF THE FIGURES

Non-limiting and non-exhaustive examples will be described with reference to the following figures, wherein like reference numerals refer to like parts throughout the various figures.

DETAILED DESCRIPTION

Figure 1:
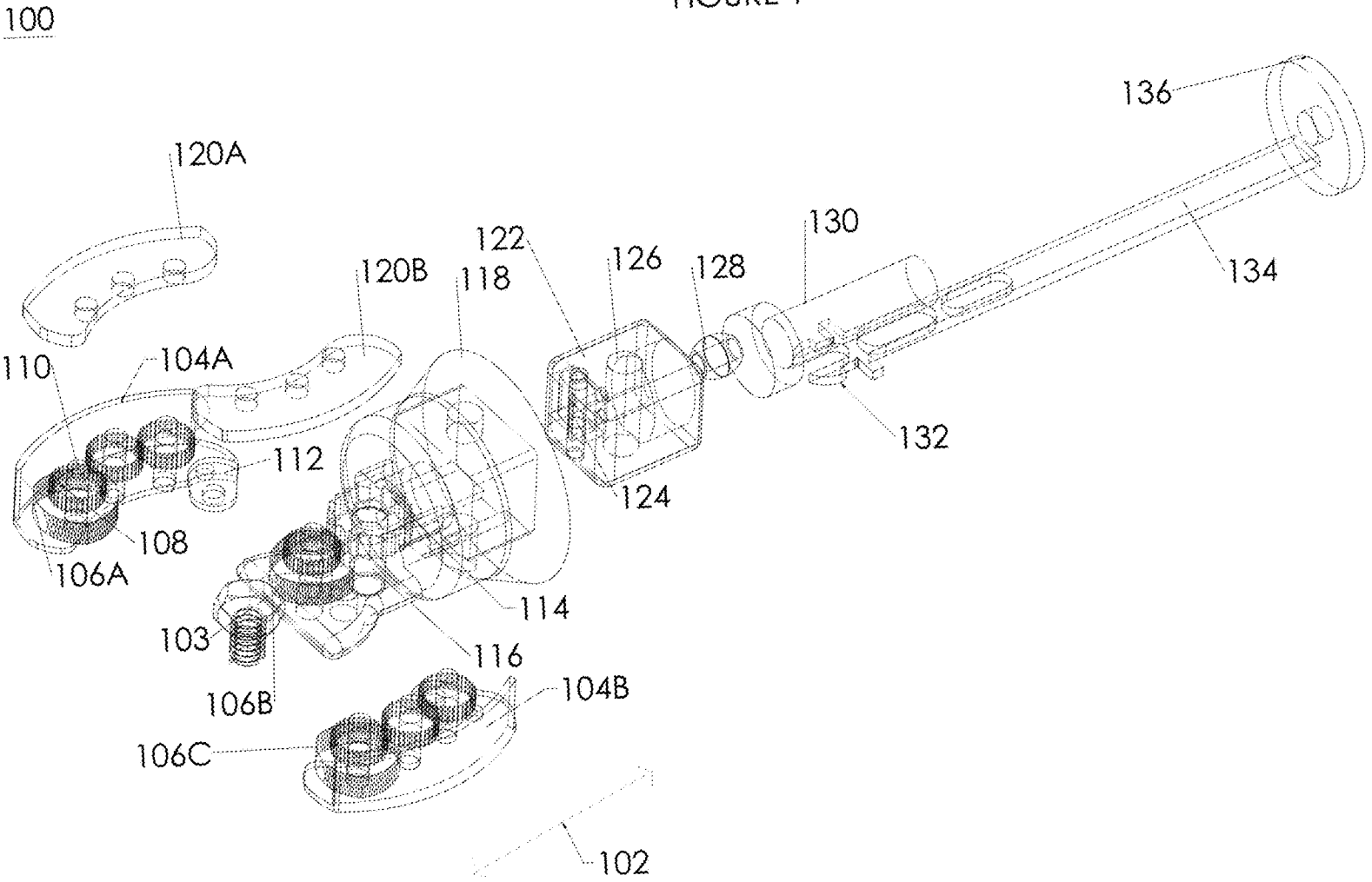
FIG. 1 is an illustration of the self-adjusting and open-ended wrench, according to one embodiment.

In FIG. 1, an illustration of the self-adjusting and open-ended wrench is shown, according to one embodiment. A first image 100 includes an open-ended and self-adjusting wrench 102, a universal adaptor 118, a ratchet tooth assembly 122, and a power tool 136. In one example, open-ended and self-adjusting wrench 102 may include a drive gear assembly. Drive gear assembly may include a primary drive gear 114 and one or more secondary drive gears 108. Primary drive gear 114 may be secured to a first element 116. One or more secondary drive gears 108 may be secured to a second element 104A and/or a third element 104B. There may be any number (e.g. 1-N) of elements in an open-ended and self-adjusting wrench 102. Further, the drive gears may be attached to any part and/or element of open-ended and self-adjusting wrench 102. In addition, the drive gears may be attached to any part and/or element of open-ended and self-adjusting wrench 102 via one or more securing devices 110. One or more securing devices 110 may be any mechanical securing devices (e.g., fastener, pin, staple, interlocking snapping mechanism, male-female securing device, nail, screw, etc.) and/or chemical securing devices (e.g., glue, welding, etc.).

In one example, open-ended and self-adjusting wrench 102 may include a cam assembly. Cam assembly may include a first cam 106B, a second cam 106A, and a third cam 106C. Cam assembly may include any number (e.g., 1-N) of cams. In this example, cam assembly (e.g., first cam 106B, second cam 106A, and third cam 106C) may be coupled to drive gear assembly (e.g., primary drive gear 114 and one or more secondary drive gears 108). In this example, drive gear assembly transfers energy (e.g., movement, the ability to move, etc.) to cam assembly. The movement (e.g., speed, direction, etc.) of the cam assembly may be dependent the movement (e.g., speed, direction, etc.) of the drive gear assembly. In one example, the movement direction of the cam assembly may be in an inverse and/or an opposite direction of the drive gear assembly. In other examples, the movement direction of the cam assembly may be in the same direction as the drive gear assembly. In various examples, the speed of the cam assembly may be less than, equal to, and/or greater than the speed of the drive gear assembly. In one example, one or more of first cam 106B, second cam 106A, and/or third cam 106C may interact with a part 103 to move part 103.

In another example, first element 116 may be attached to one or more of second element 104A and/or third element 104B via one or more attachment/support structures 112. In another example, a first shield 120A may be attached to second element 104A to protect one or more elements attached to, on, and/or in proximity to second element 104A. Further, a second shield 120B may be attached to third element 104B to protect one or more elements attached to, on, and/or in proximity to third element 104B.

In one example, open-ended and self-adjusting wrench 102 may include universal adaptor 118. In another example, open-ended and self-adjusting wrench 102 may be able to attach to, be coupled with, and/or interact with universal adaptor 118. In one example, universal adaptor 118 may allow one or more power tools (and/or power tool types) to interact with, transfer energy to, and/or control open-ended and self-adjusting wrench 102. In one example, universal adaptor 118 is a device that provides a path way and/or an interface device which allows one or more devices to interact with open-ended and self-adjusting wrench 102.

In one example, open-ended and self-adjusting wrench 102 may include ratchet tooth assembly 122. In another example, open-ended and self-adjusting wrench 102 may be able to attach to, be coupled with, and/or interact with ratchet tooth assembly 122. In another example, open-ended and self-adjusting wrench 102 may be able to attach to, be coupled with, and/or interact with ratchet tooth assembly 122 via universal adaptor 118. In one example, ratchet tooth assembly 122 may allow one or more power tools (and/or power tool types) to interact with, transfer energy to, and/or control open-ended and self-adjusting wrench 102. In one example, ratchet tooth assembly 122 is a device that provides a path way and/or an interface device which allows one or more devices to interact with open-ended and self-adjusting wrench 102.

In one example, power tool 136 may be any power tool (e.g., air, electric, mechanical, etc.). Further, power tool 136 may interact with, transfer energy to, and/or control open-ended and self-adjusting wrench 102.

First image 100 includes ratchet tooth assembly 122. Ratchet tooth assembly 122 may include a ratchet pivot axis 126 and one or more spring-loaded teeth assemblies 124. Ratchet tooth assembly 122 may transfer energy (e.g., move one or more drive gears, strike one or more drive gears, etc.) to open-ended and self-adjusting wrench 102 by movement around ratchet pivot axis 126 while one or more spring-loaded teeth assemblies 124 moves one or more drive gears, strikes one or more drive gears, any other energy transfer configuration, and/or any other energy transfer method.

In another example, first image 100 includes a ratchet ball 128, a ball pin assembly 130, one or more attachment arms 132, and a closure lever 134. In this example, ratchet ball 128 may be coupled to an energy transfer opening 152 (see FIG. 2) of ratchet tooth assembly 122. In this example, ratchet ball 128 may move in a circular (and/or elliptical and/or any other shape) motion inside of energy transfer opening 152 to transfer energy (e.g., movement, etc.) to ratchet tooth assembly 122. Based on this energy transfer, one or more spring-loaded teeth assemblies 124 moves and/or strikes one or more drive gears.

In another example, first image 100 includes ball pin assembly 130, which may be utilized to transfer energy from power tool 136 to one or more of ratchet ball 128, ratchet tooth assembly 122, one or more spring-loaded teeth assemblies 124, one or more drive gears, one or more cams, and/or any other device.

In another example, first image 100 includes one or more attachment arms 132 and closure lever 134. In this example, one or more attachment arms 132 may be coupled to (e.g., attached to) open-ended and self-adjusting wrench 102 at one or more locations. Based on a user utilizing a trigger (e.g., button, selection device, etc.) mechanism, closure lever 134 via one or more attachment arms 132 may close second element 104A and/or third element 104B. For example, second element 104A and/or third element 104B may move towards each other based on closure lever 134 moving away from open-ended and self-adjusting wrench 102. In another example, closure lever 134 may not move away from open-ended and self-adjusting wrench 102 while closing second element 104A and/or third element 104B. This may be accomplished via one or more powered devices attached to closure lever 134, one or more attachment arms 132, second element 104A, third element 104B, any other device in open-ended and self-adjusting wrench 102, and/or any other device coupled to open-ended and self-adjusting wrench 102. In various other examples, a light source may be attached to any element of open-ended and self-adjusting wrench 102 to provide light. Further, a light source may be attached to any element coupled to, attached to, and/or in proximity to open-ended and self-adjusting wrench 102.

Figure 2:
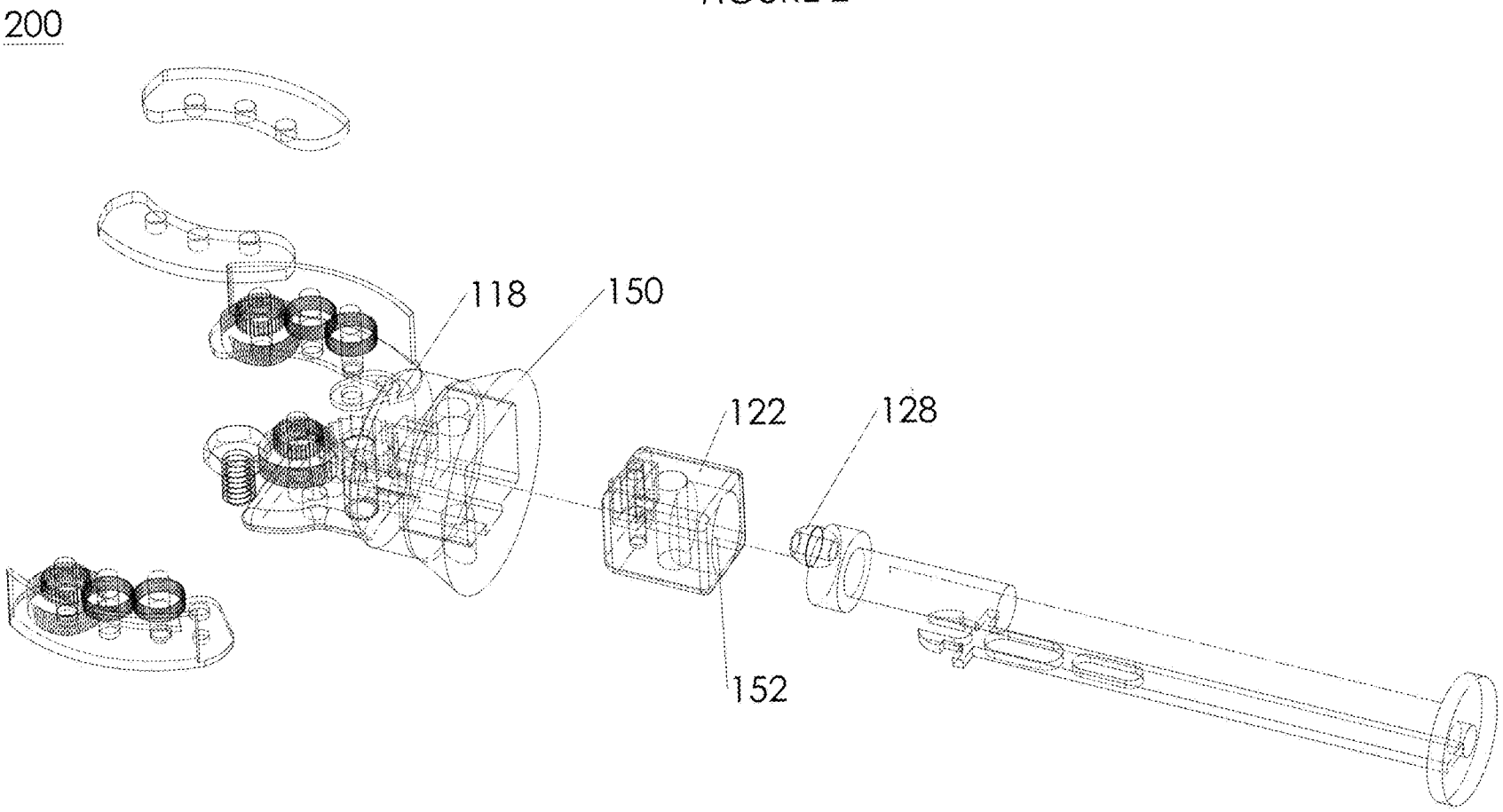
FIG. 2 is another illustration of the self-adjusting and open-ended wrench, according to one embodiment.

In FIG. 2, another illustration of the self-adjusting and open-ended wrench is shown, according to one embodiment. A second image 200 may include universal adaptor 118, ratchet tooth assembly 122, ratchet ball 128, a universal adaptor-to-ratchet tooth assembly opening 150, and energy transfer opening 152. In one example, ratchet tooth assembly 122 is connected to universal adapter by inserting (e.g., coupling, attaching, etc.) ratchet tooth assembly into universal adaptor-to-ratchet tooth assembly opening 150. Further, ratchet ball 128 is connected to ratchet tooth assembly by inserting (e.g., coupling, attaching, etc.) ratchet ball 128 into energy transfer opening 152.

Figure 3A:
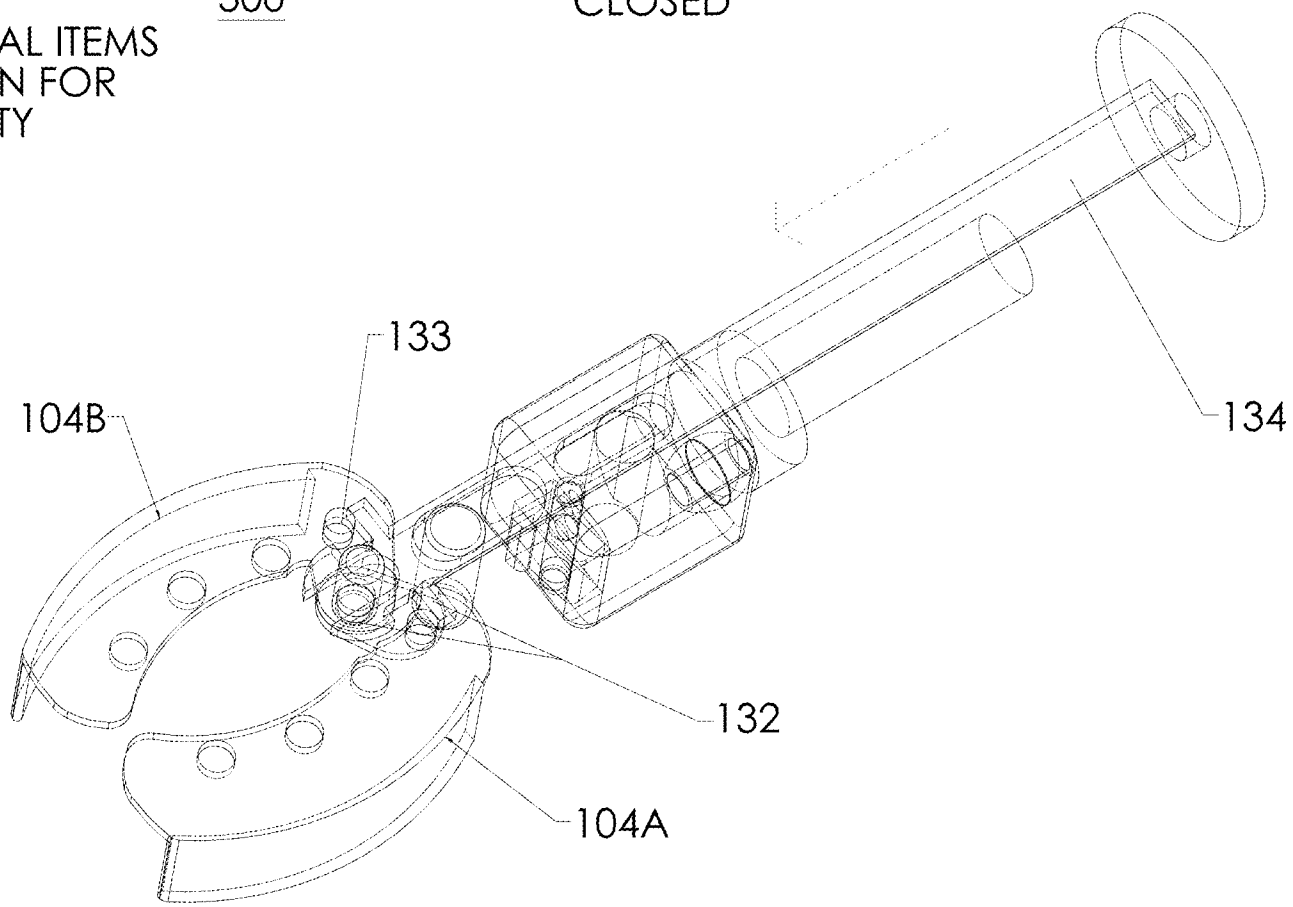
FIG. 3A is another illustration of the self-adjusting and open-ended wrench, according to one embodiment.

In FIG. 3A, another illustration of the self-adjusting and open-ended wrench is shown, according to one embodiment. A third image 300 shows that second element 104A and/or third element 104B have moved towards each other to form a closed position and/or a partially closed position. In this example, one or more attachment arms 132 have attached to (e.g., been coupled to, etc.) one or more attachment points 133 on self-adjusting and open-ended wrench 120. In various examples, there may be any number (e.g., 1-N) of attachment arms and/or attachment points. Further, closure lever 134 may move one, a few, a plurality, and/or all of one or more attachment arms 132 and/or one or more attachment points 133. In addition, closure lever 134 may move one, a few, a plurality, and/or all of one or more attachment arms 132 and/or one or more attachment points 133 to open, partially open, close, and/or partially close first element 116, second element 104A, third element 104B, any other device in self-adjusting and open-ended wrench 120, any other device attached to self-adjusting and open-ended wrench 120, any other device coupled to self-adjusting and open-ended wrench 120, and/or any other device in proximity to self-adjusting and open-ended wrench 120.

Figure 3B:
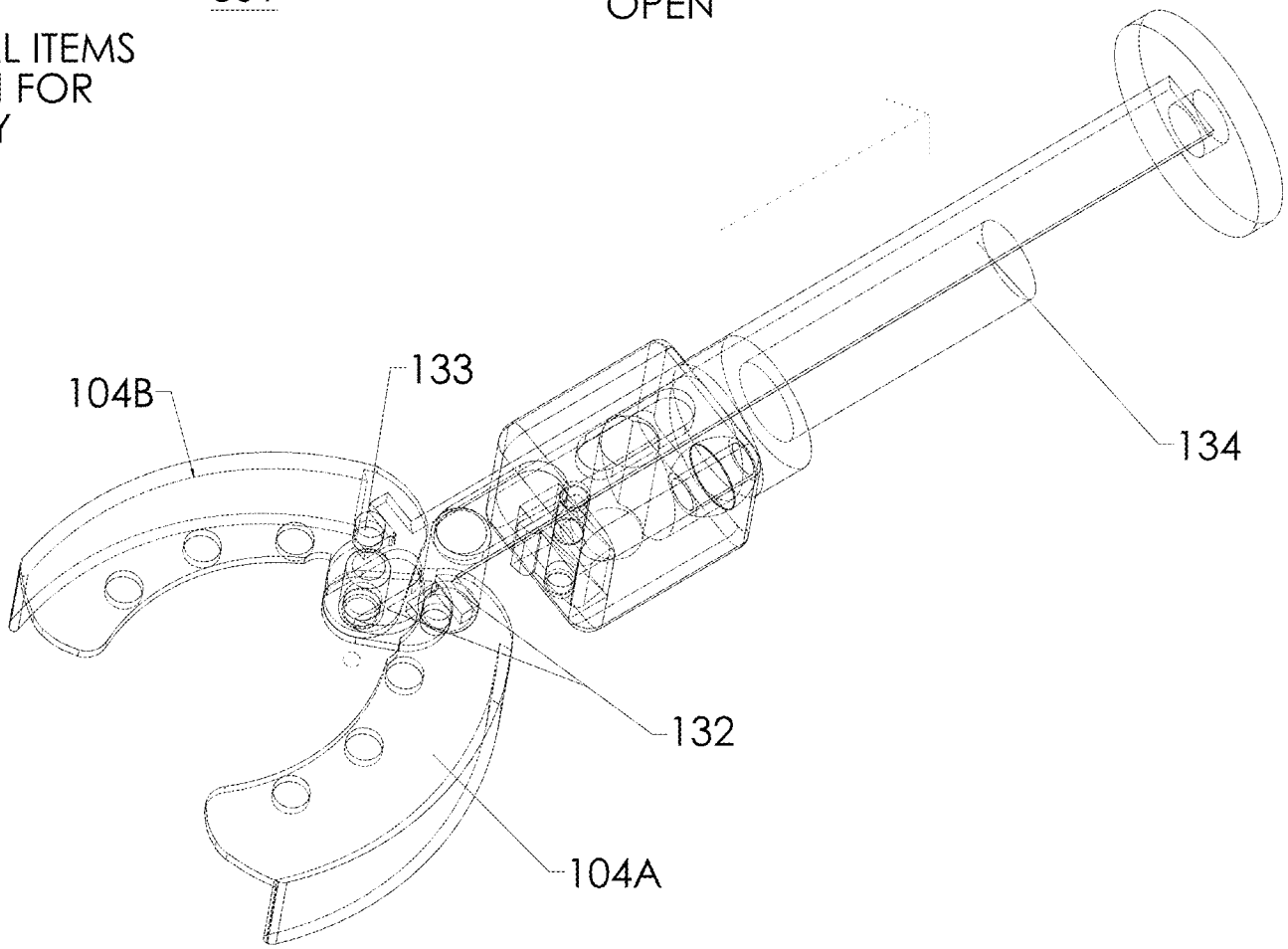
FIG. 3B is another illustration of the self-adjusting and open-ended wrench, according to one embodiment.

In FIG. 3B, another illustration of the self-adjusting and open-ended wrench is shown, according to one embodiment. A fourth image 301 shows that second element 104A and/or third element 104B have moved away from each other to form an open position and/or a partially open position. In this example, one or more attachment arms 132 have attached to (e.g., been coupled to, etc.) one or more attachment points 133 on self-adjusting and open-ended wrench 120. In various examples, there may be any number (e.g., 1-N) of attachment arms and/or attachment points. Further, closure lever 134 may move one, a few, a plurality, and/or all of one or more attachment arms 132 and/or one or more attachment points 133. In addition, closure lever 134 may move one, a few, a plurality, and/or all of one or more attachment arms 132 and/or one or more attachment points 133 to open, partially open, close, and/or partially close first element 116, second element 104A, third element 104B, any other device in self-adjusting and open-ended wrench 120, any other device attached to self-adjusting and open-ended wrench 120, any other device coupled to self-adjusting and open-ended wrench 120, and/or any other device in proximity to self-adjusting and open-ended wrench 120.

Figures 4A, 4B, 4C, 4D, 4E:
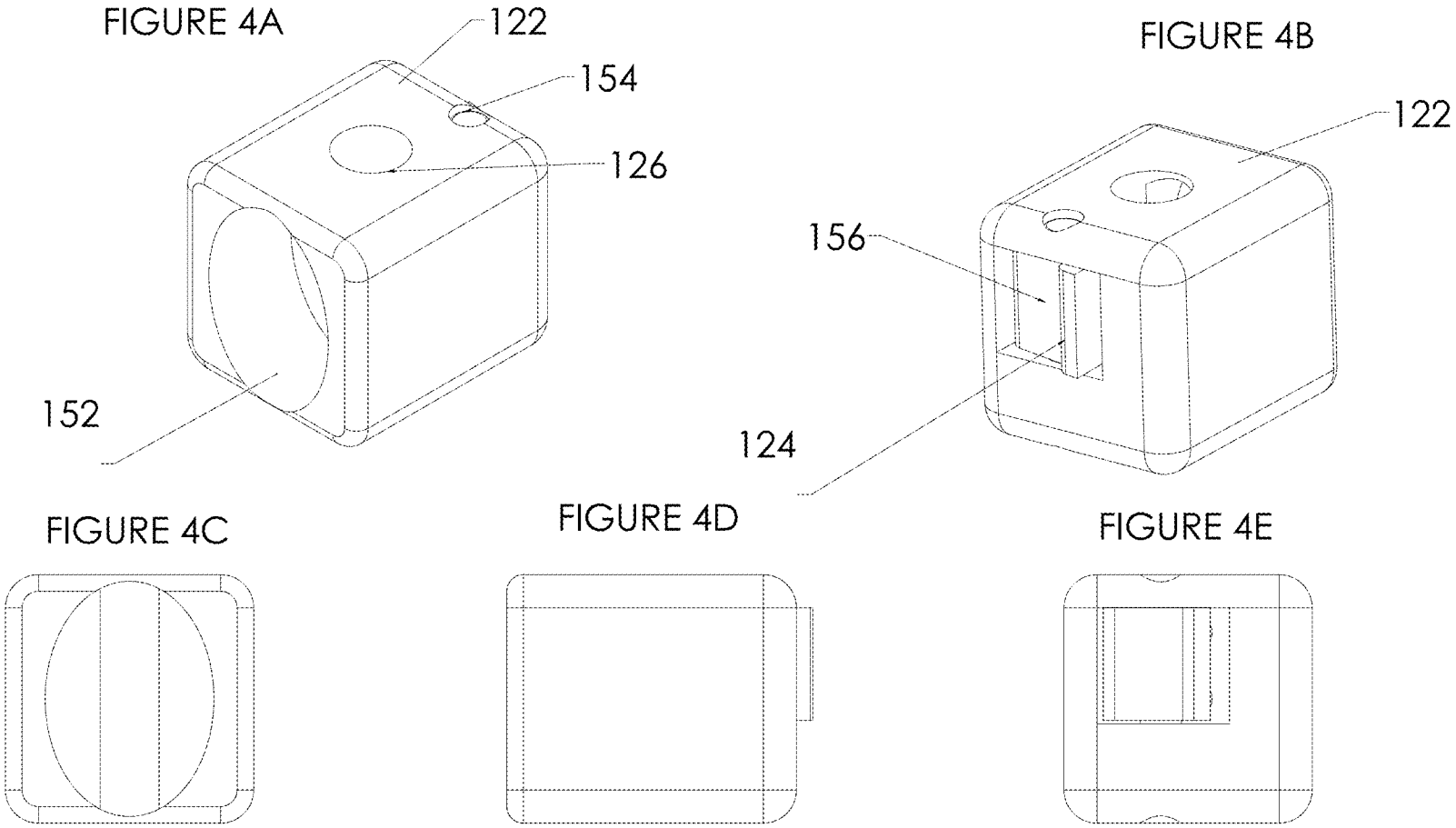
FIGS. 4A-4F are illustrations of the ratchet tooth assembly, according to various embodiments.

In FIGS. 4A-4F, various illustrations of the ratchet tooth assembly are shown, according to various embodiments. FIG. 4A shows ratchet tooth assembly 122, ratchet pivot axis 126, energy transfer opening 152, and a ratchet pivot point 154. FIG. 4B shows ratchet tooth assembly 122, one or more spring-loaded teeth assemblies 124, and one or more spring devices 156. FIG. 4C shows a side view of ratchet tooth assembly 122 on the energy transfer opening side. FIG. 4D shows another side view of ratchet tooth assembly 122. FIG. 4E shows a side view of ratchet tooth assembly 122 on the one or more spring-loaded teeth assemblies' side.

Figure 4F:
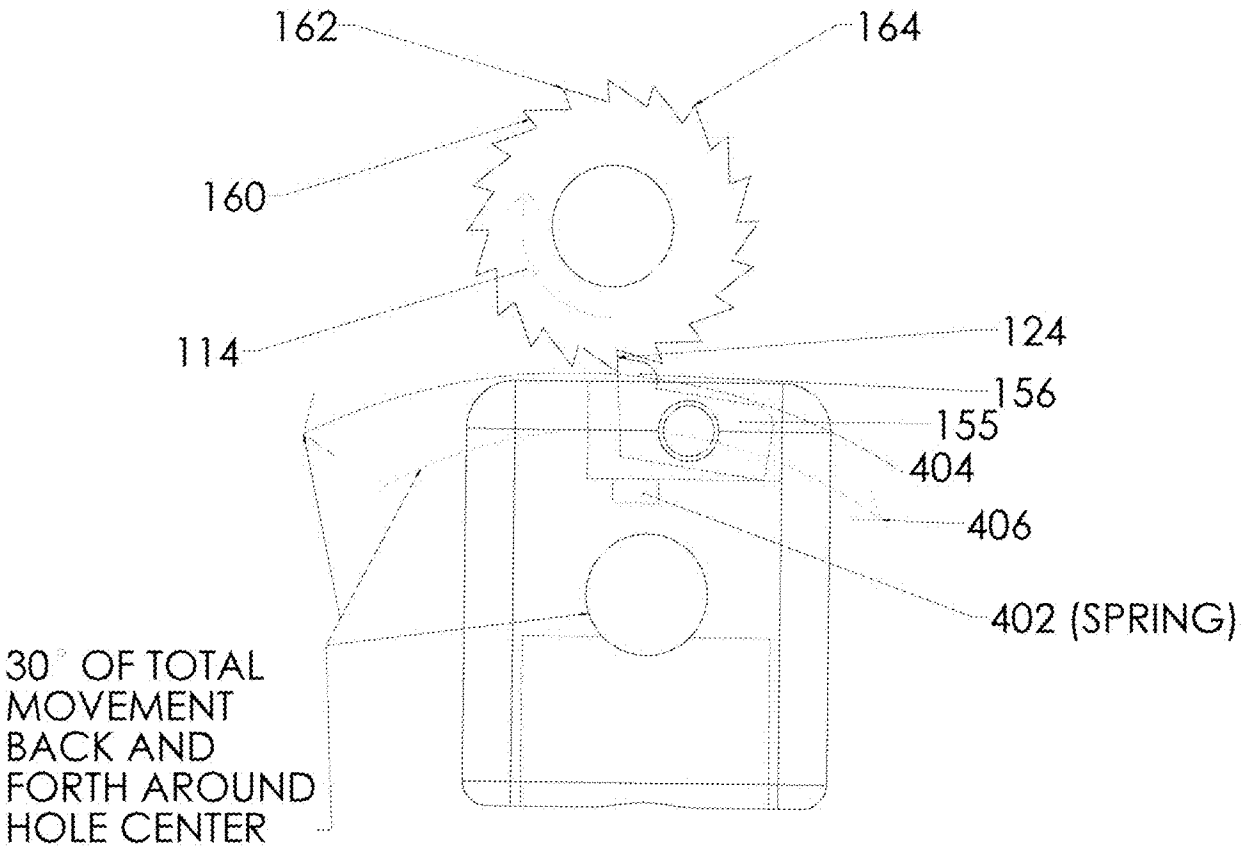

In FIG. 4F, an illustration of the interaction between the ratchet tooth assembly and the drive gear assembly is shown. A fifth image 400 includes ratchet tooth assembly 122, one or more loaded springs 402, a tooth 124, a tooth base 155, primary gear 114, a first primary gear tooth 160, a second primary gear tooth 162, and a third primary gear tooth 164. In one example, tooth 125 is positioned on top of tooth base 155. In this example, one or more loaded springs 402 makes contact with tooth base 155. In this example, as tooth 125 and tooth base 155 move in a leftward movement pattern 404, tooth 125 moves a primary gear tooth in a clockwise direction. In this example, a primary gear tooth moves in a clockwise direction which moves first primary gear tooth 160 up and to the right, second primary gear tooth 162 slightly up and to the right, and third primary gear tooth 164 down and to the right. Once tooth 125 moves primary gear tooth to the left, tooth 125 then moves in a rightward movement pattern 406. During this rightward movement pattern 406, tooth is reset onto a new primary gear tooth via tooth base 155 and one or more loaded springs 402. This energy (e.g., movement) and/or a portion of this energy (e.g., movement) transferred from ratchet tooth assembly to drive gear assembly is transferred to one or more cams via one or more gears. In one example, 30 degrees of total movement back and forth is around the center hole. In various examples, any degrees (e.g., 0 degree, 1 degree, 2 degrees, 3 degrees, 10 degrees, 15 degrees, 20 degrees, 26 degrees, 29 degrees, 31 degrees, 43 degrees, etc.) may be utilized.

Figure 5:
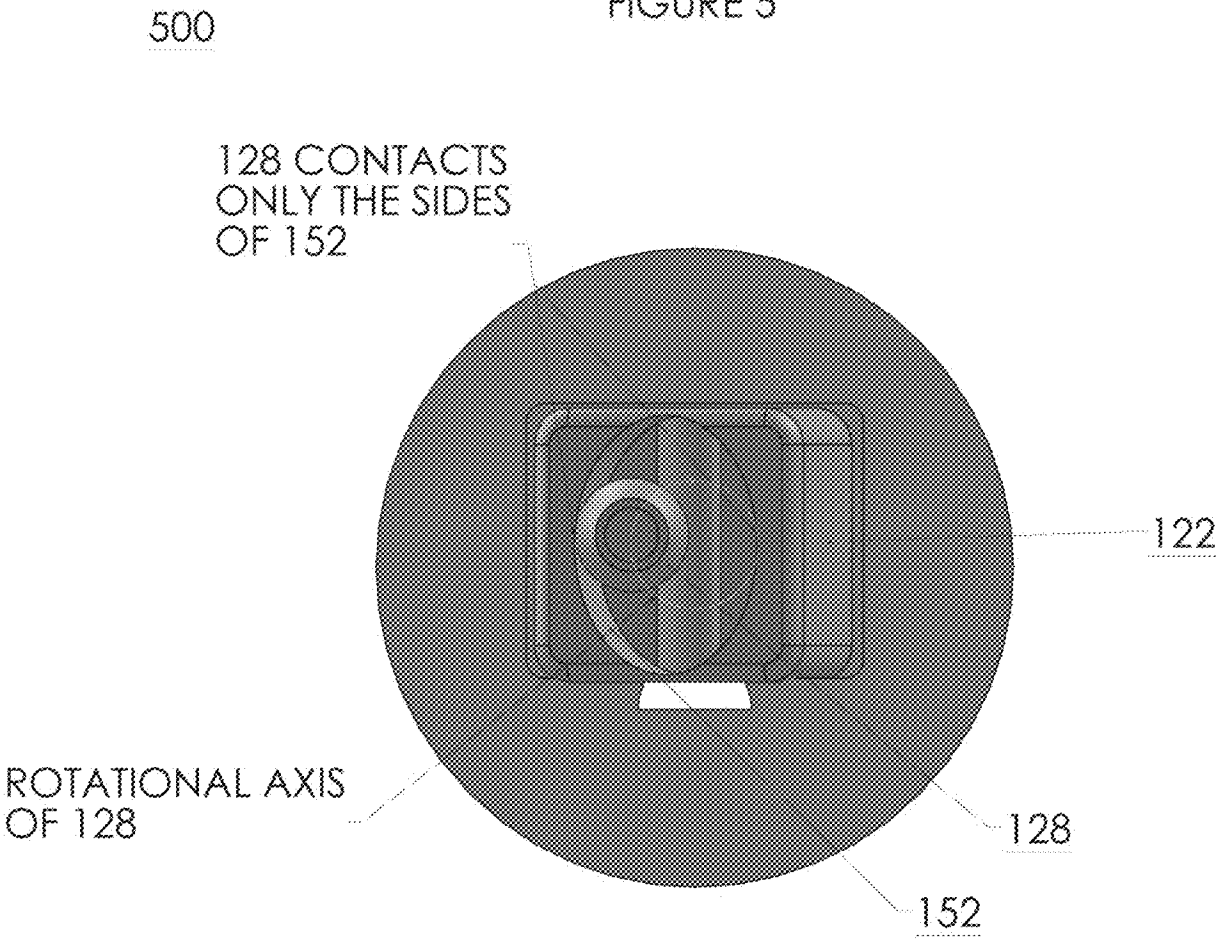
FIG. 5 is an illustration of the movement mechanism for the ratchet tooth assembly, according to one embodiment.

In FIG. 5, an illustration of the movement mechanism for the ratchet tooth assembly is shown, according to one embodiment. In one example, ratchet ball 128 is inserted into ratchet tooth assembly 122 via energy transfer opening 152. In this example, one or more spring-loaded teeth assemblies 124 and/or one or more spring devices 156 are located (and/or coupled to and/or attached to and/or in proximity to) inside of ratchet tooth assembly 122.

In one example, as rotary force is applied to ratchet ball 128 (e.g., ball pin assembly, etc.), ratchet ball 128 spins on its axis. In one example, ratchet ball 128 is off center but concentrically. In another example, ratchet ball 128 is centered. Any mounting position may be utilized to transfer energy. In an example, ratchet ball 128 is mounted and spins in a larger circle inside ratchet tooth assembly 122. Further, ratchet ball 128 may be mounted so that it fits inside the back of ratchet tooth assembly 122 in the elliptical relief cut out (e.g., energy transfer opening 152). This mating relationship causes ratchet ball 128 to collide only on the left and right of ratchet tooth assembly 122 but not on the top or bottom. This action causes ratchet tooth assembly 122 to pivot back and forth at a high rate of speed and impact. In one example, this back and forth movement of ratchet tooth assembly 122 transfers energy (e.g., movement, etc.) to tooth 125 which is positioned on top of tooth base 155. Further, one or more loaded springs 402 makes contact with tooth base 155. As tooth 125 and tooth base 155 move in a leftward movement pattern 404, tooth 125 moves a primary gear tooth in a clockwise direction. In this example, a primary gear tooth moves in a clockwise direction which moves first primary gear tooth 160 up and to the right, second primary gear tooth 162 slightly up and to the right, and third primary gear tooth 164 down and to the right (see FIG. 4F). Once tooth 125 moves primary gear tooth to the left, tooth 125 then moves in a rightward movement pattern 406 which may be matched (e.g., same direction—both parts move together, opposite direction—both parts move in opposite direction, etc.) with the movement of ratchet ball 128. Further, it should be noted that the speed of both parts may be the same and/or different depending on the design. During this rightward movement pattern 406, tooth is reset onto a new primary gear tooth via tooth base 155 and one or more loaded springs 402. This energy (e.g., movement) and/or a portion of this energy (e.g., movement) transferred from ratchet tooth assembly to drive gear assembly may be transferred to one or more cams. In one example, 60 degrees of total movement back and forth is around the center hole. In various examples, any degrees (e.g., 45 degree, 46 degree, 47 degrees, 48.1 degrees, 49.7 degrees, 50.11 degrees, 53.001 degrees, 55 degrees, 59 degrees, 61 degrees, 83 degrees, etc.) may be utilized.

Figure 6:
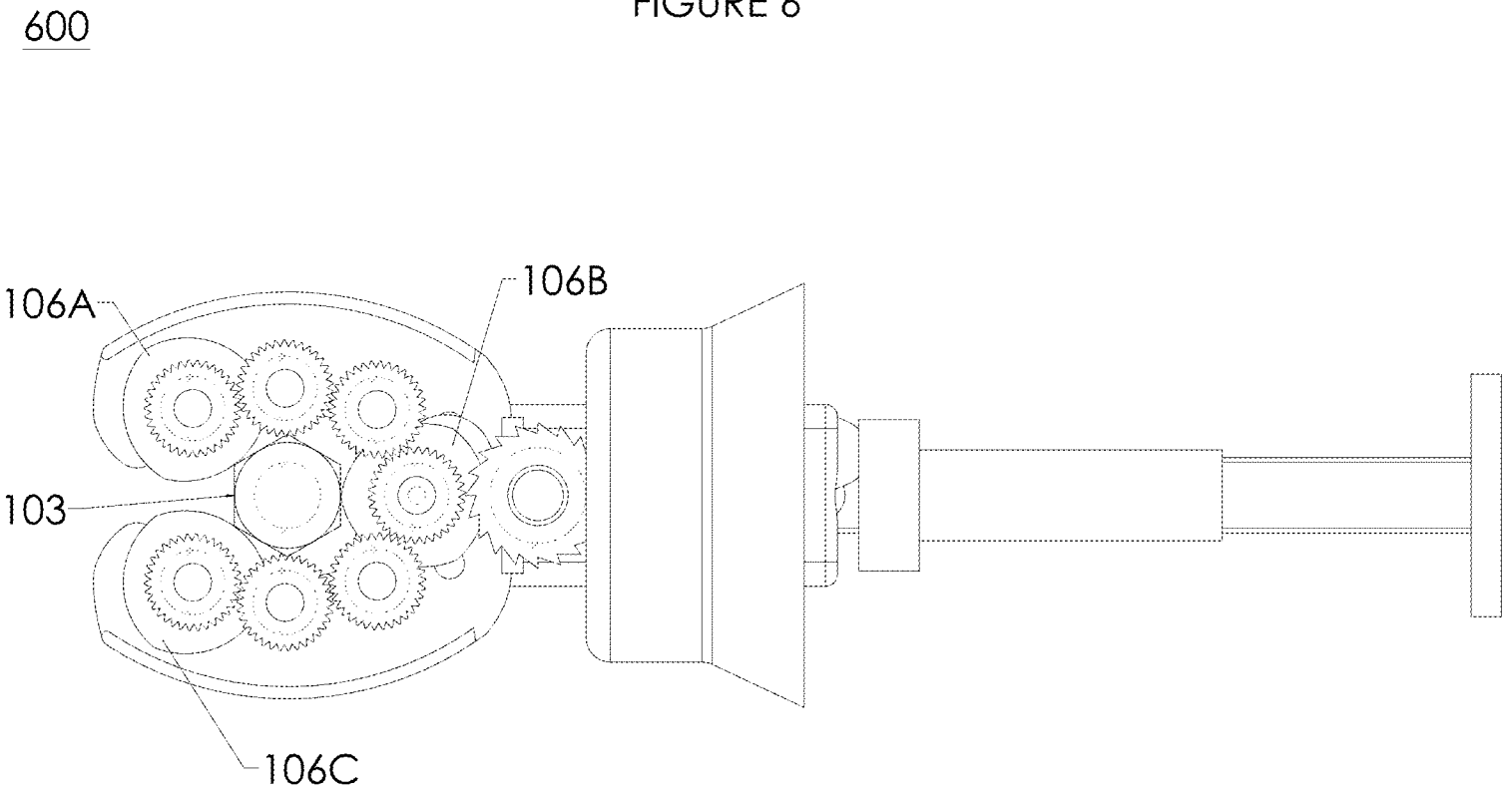
FIG. 6 is a diagram showing movement of the part, according to one embodiment.

In FIG. 6, a diagram showing movement of the part is shown, according to one embodiment. A sixth image 600 includes first cam 106B, second cam 106A, and/or third cam 106C. First cam 106B, second cam 106A, and/or third cam 106C may interact with part 103 to move part 103. In various embodiments, any number (e.g., 1-N) of cams may be utilized. In one example, first cam 106B, second cam 106A, and/or third cam 106C may move in a clockwise direction to tighten and/or loosen part. Further, first cam 106B, second cam 106A, and/or third cam 106C may move in a counter-clockwise direction to tighten and/or loosen part. In another example, first cam 106B and second cam 106A may move in a clockwise direction to tighten and/or loosen part. In another example, first cam 106B and second cam 106A may move in a counter-clockwise direction to tighten and/or loosen part. In another example, third cam 106C and second cam 106A may move in a clockwise direction to tighten and/or loosen part. In another example, third cam 106C and second cam 106A may move in a counter-clockwise direction to tighten and/or loosen part. In another example, first cam 106B and third cam 106C may move in a clockwise direction to tighten and/or loosen part. In another example, first cam 106B and third cam 106C may move in a counter-clockwise direction to tighten and/or loosen part. In one example, first cam 106B, second cam 106A, third cam 106C, and Nth cam (not shown) may move in a clockwise direction to tighten and/or loosen part. Further, first cam 106B, second cam 106A, third cam 106C, and Nth cam may move in a counter-clockwise direction to tighten and/or loosen part. In one example, one or more cams may not move while other cams are moving.

Figures 7A, 7B:
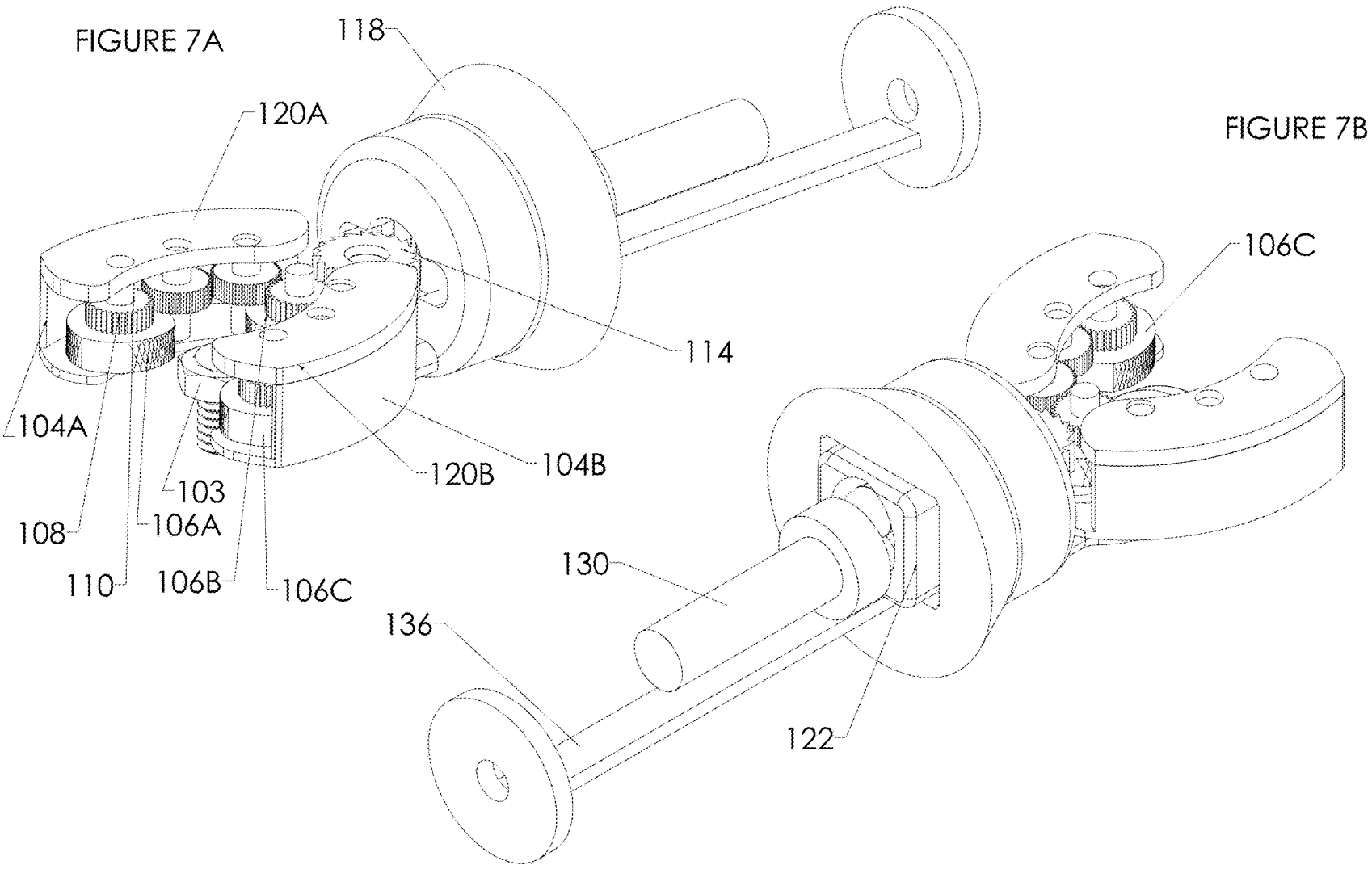
FIG. 7A is another illustration of the self-adjusting and open-ended wrench, according to one embodiment.
FIG. 7B is another illustration of the self-adjusting and open-ended wrench, according to one embodiment.

In FIG. 7A, another illustration of the self-adjusting and open-ended wrench, according to one embodiment. In one example, open-ended and self-adjusting wrench 102 may include a drive gear assembly. Drive gear assembly may include primary drive gear 114 and one or more secondary drive gears 108. Primary drive gear 114 may be secured to first element 116 (see FIG. 1). One or more secondary drive gears 108 may be secured to second element 104A and/or third element 104B.

In one example, open-ended and self-adjusting wrench 102 may include a cam assembly. Cam assembly may include first cam 106B, second cam 106A, third cam 106C, and/or Nth cam (not shown). Cam assembly may include any number (e.g., 1-N) of cams. In this example, cam assembly (e.g., first cam 106B, second cam 106A, and third cam 106C) may be coupled to drive gear assembly (e.g., primary drive gear 114 and one or more secondary drive gears 108). In this example, drive gear assembly transfer energy (e.g., movement, the ability to move, etc.) to cam assembly. The movement (e.g., speed, direction, etc.) of the cam assembly is dependent on the movement (e.g., speed, direction, etc.) of the drive gear assembly. In one example, one or more of first cam 106B, second cam 106A, and/or third cam 106C may interact with part 103 to move part 103.

In another example, first shield 120A may be attached to second element 104A to protect one or more elements attached to, on, and/or in proximity to second element 104A. Further, second shield 120B may be attached to third element 104B to protect one or more elements attached to, on, and/or in proximity to third element 104B.

In one example, open-ended and self-adjusting wrench 102 may include universal adaptor 118. In another example, open-ended and self-adjusting wrench 102 may be able to attach to, be coupled with, and/or interact with universal adaptor 118. In one example, universal adaptor 118 may allow one or more power tools (and/or power tool types) to interact with, transfer energy to, and/or control open-ended and self-adjusting wrench 102. In one example, universal adaptor 118 is a device that provides a path way and/or an interface device which allows one or more devices to interact with open-ended and self-adjusting wrench 102.

In one example, open-ended and self-adjusting wrench 102 may include ratchet tooth assembly 122 (see FIG. 7B). In another example, open-ended and self-adjusting wrench 102 may be able to attach to, be coupled with, and/or interact with ratchet tooth assembly 122. In another example, open-ended and self-adjusting wrench 102 may be able to attach to, be coupled with, and/or interact with ratchet tooth assembly 122 via universal adaptor 118. In one example, ratchet tooth assembly 122 may allow one or more power tools (and/or power tool types) to interact with, transfer energy to, and/or control open-ended and self-adjusting wrench 102. In one example, ratchet tooth assembly 122 is a device that provides a path way and/or an interface device which allows one or more devices to interact with open-ended and self-adjusting wrench 102.

In one example, power tool 136 may be any power tool (e.g., air, electric, mechanical, etc.). Further, power tool 136 may interact with, transfer energy to, and/or control open-ended and self-adjusting wrench 102.

In another example, ball pin assembly 130 may be utilized to transfer energy from power tool 136 to one or more of ratchet ball 128, ratchet tooth assembly 122, one or more spring-loaded teeth assemblies 124, one or more drive gears, one or more cams, and/or any other device (see FIG. 1, FIG. 2, FIG. 4F, and FIG. 5).

Figure 8:
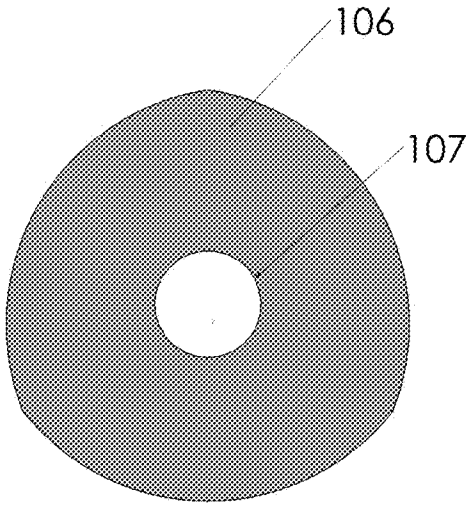
FIG. 8 shows various illustrations of the one or more cams, according to various embodiments.
Figure 8:
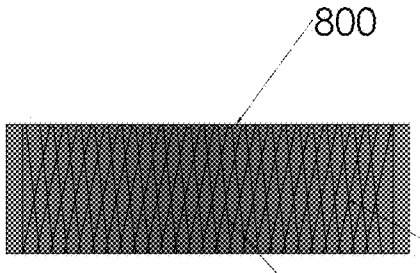

FIG. 8 shows various illustrations of the one or more cams, according to various embodiments. One or more cams 106 may include one or more connection points 107. One or more connections points 107 may connect one or more cams 106 via a mechanical procedure, a chemical procedure, and/or any other connection process. Further, an outer surface of the cam 800 may include a gripping surface 802. In one example, outer surface of cam 800 may be treated, such that, a course diamond knurled surface is applied before heat treating. In various other examples, tungsten carbide may be utilized; titanium material may be utilized; any other surface treatment; any other material; and/or any combination thereof. In another example, a rubber (e.g., plastic, and/or any other softer material) surface may be applied to outer surface of cam 800. In this case, the rubber may allow the wrench to be utilized with more fragile materials (e.g., electronics, plastic, etc.). Any combination of materials (e.g., metals, plastics, rubber, etc.) may be utilized in the creation of the cams to provide varying strength, gripping power, precision, and/or touch (e.g., gentleness for specific material—electronics—plastics).

Figure 9:
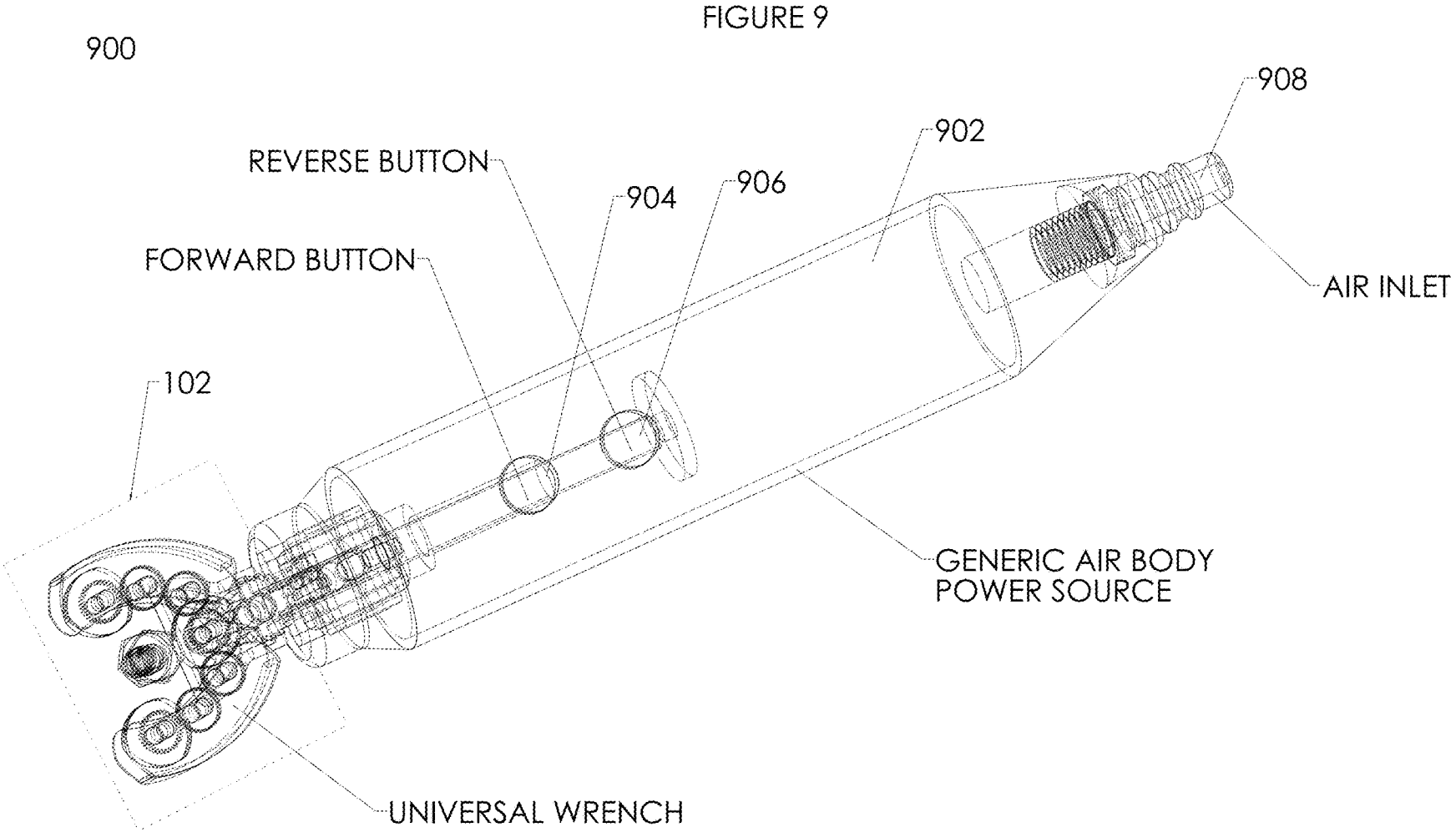
FIG. 9 is an illustration of one power tool being utilized with the self-adjusting and open-ended wrench, according to one embodiment.

In FIG. 9, an illustration of one power tool being utilized with the self-adjusting and open-ended wrench is shown, according to one embodiment. A seventh image 900 includes a power tool 902 and self-adjusting and open-ended wrench 102. In one example, power tool 902 may include a forward button 904, a reverse button 906, and an air inlet area 908. In one example, when forward button 904 is selected one or more cams in self-adjusting and open-ended wrench 102 move in a first direction (e.g., clockwise). Further, when reverse button 906 is selected one or more cams in self-adjusting and open-ended wrench 102 move in a second direction (e.g., counter-clockwise).

Figure 10A:
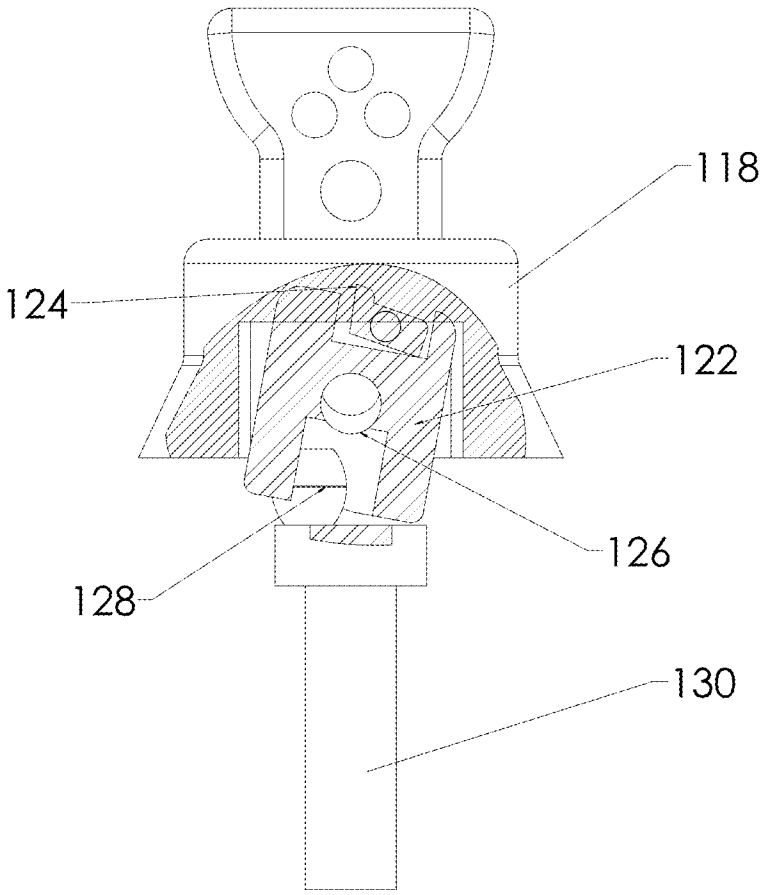
FIG. 10A is an illustration of the power transfer mechanism, according to one embodiment.

In FIG. 10A, another illustration of the self-adjusting and open-ended wrench is shown, according to one embodiment. In one example, ratchet ball 128 is inserted into ratchet tooth assembly 122 via energy transfer opening 152 (see FIG. 2). In this example, one or more spring-loaded teeth assemblies 124 and/or one or more spring devices 156 are located (and/or coupled to and/or attached to and/or in proximity to) inside of ratchet tooth assembly 122.

Figure 10B:
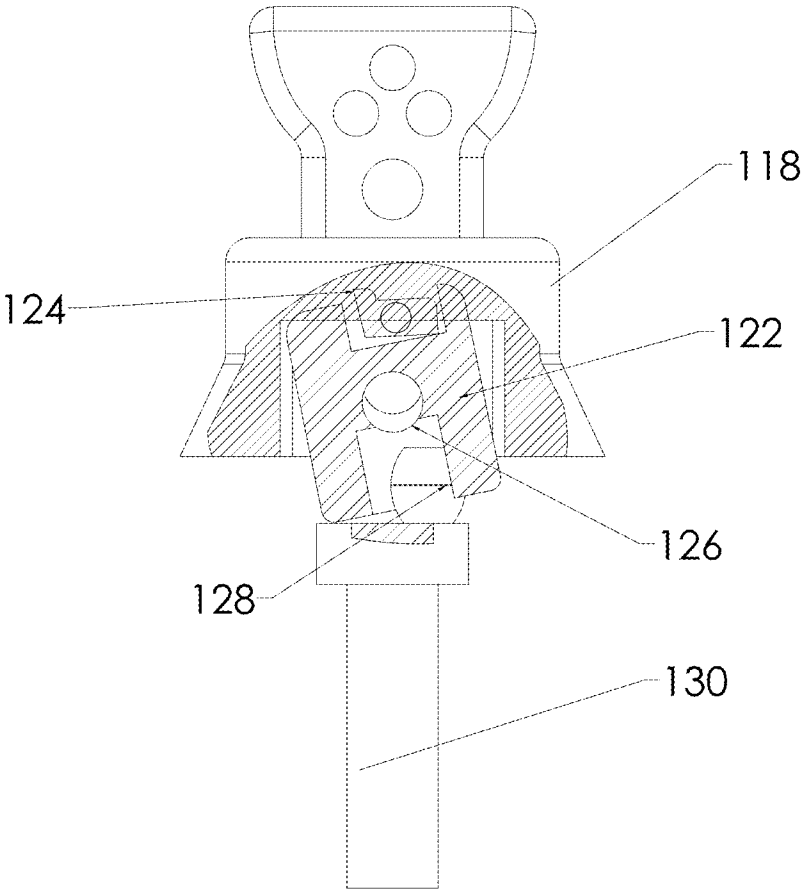
FIG. 10B is another illustration of the power transfer mechanism, according to one embodiment.

In one example, as rotary force is applied to ratchet ball 128 (via ball pin assembly, etc.), ratchet ball 128 spins on its axis (and/or spins off its axis center). In one example, ratchet ball 128 is off center but concentrically. In another example, ratchet ball 128 is centered. In an example, ratchet ball 128 is mounted and spins in a larger circle inside ratchet tooth assembly 122. The movement of ratchet ball 128 may be seen by comparing the positions of ratchet ball 128 in FIG. 10A to FIG. 10B. Further, ratchet ball 128 may be mounted so that it fits inside the back of ratchet tooth assembly 122 in the elliptical relief cut out (e.g., energy transfer opening 152). This mating relationship causes ratchet ball 128 to collide only on the left and right of ratchet tooth assembly 122 but not on the top or bottom. This action causes ratchet tooth assembly 122 to pivot back and forth at a high rate of speed and impact.

Figure 11:
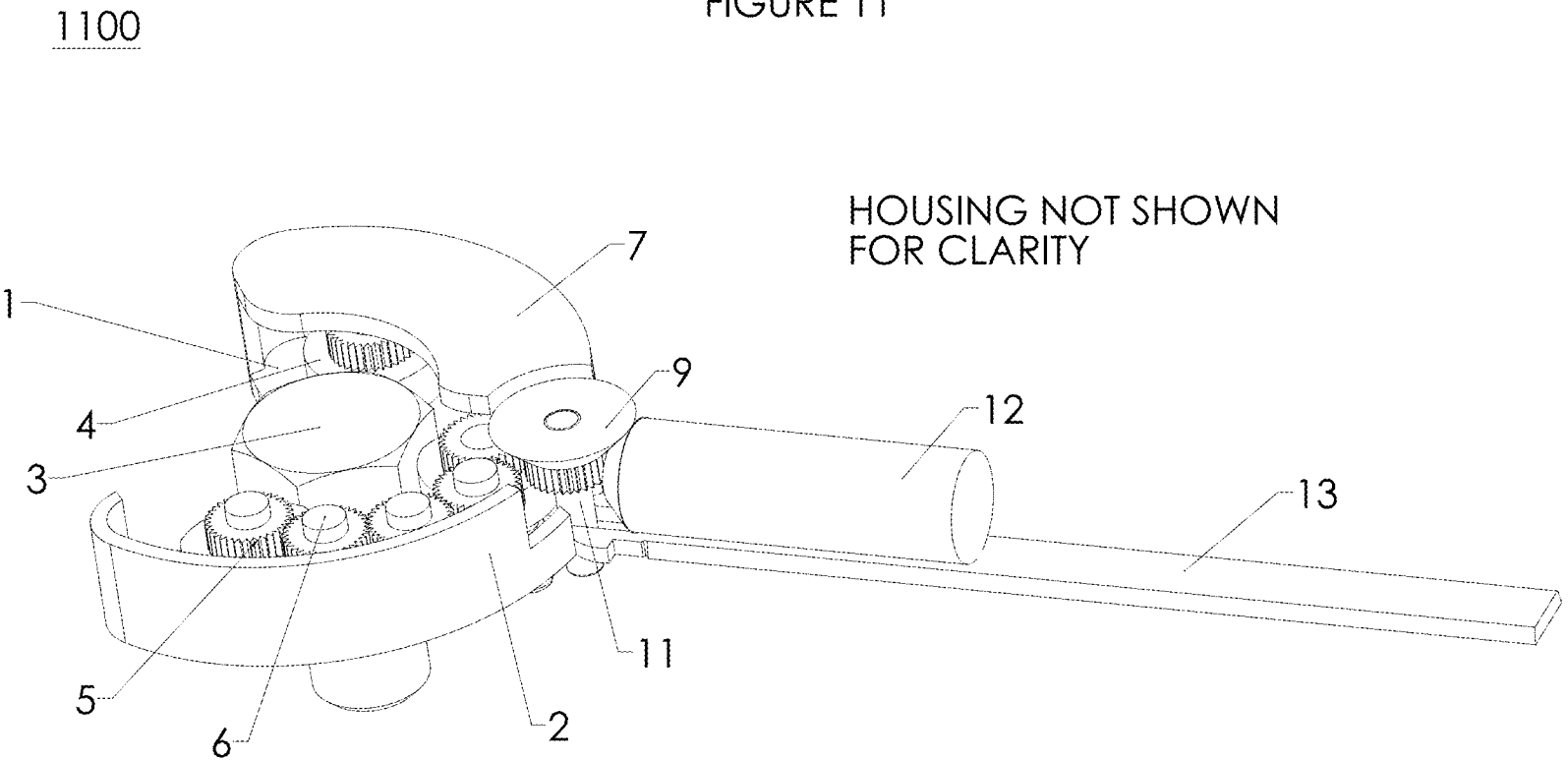
FIG. 11 is another illustration of the self-adjusting and open-ended wrench, according to one embodiment.

In FIG. 11, another illustration of the self-adjusting and open-ended wrench is shown, according to one embodiment. In this example, self-adjusting and open-ended wrench 120 does not include (and/or is not attached to and/or is not coupled to) universal adaptor 118 and/or ratchet tooth assembly 122. In this example, the energy transfer from power tool 902 occurs directly between self-adjusting and open-ended wrench 120 and power tool 902. In this alternative image 1100, the self-adjusting and open-ended wrench includes one or more cams 4 located on one or more surfaces 1. Further, the self-adjusting and open-ended wrench includes one or more drive gears 5. In this example, one or more cams 4 and/or one or more drive gears 5 may be attached by one or more attachment structures 6 to one or more surfaces 1. In another example, a side shield 2 and/or a top shield 7 may be utilized. In another example, a primary drive gear 9 may be attached to a surface via another support structure 11. Further, an assembly 12 may be utilized to power the drive gear assembly and/or the self-adjusting and open-ended wrench. In addition, a closure device 13 may be utilized.

Figure 12:
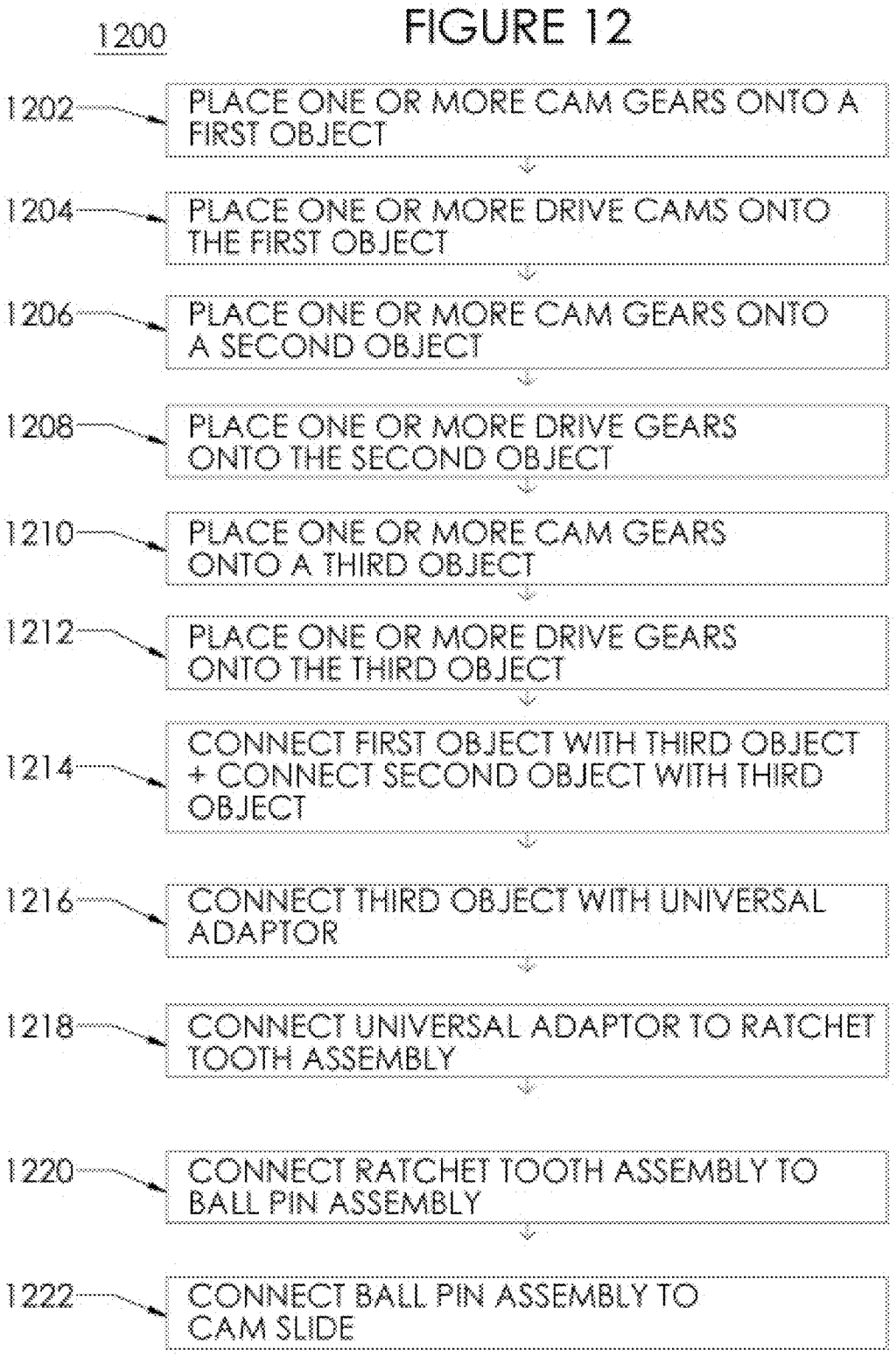
FIG. 12 is a flow diagram of one manufacturing procedure, according to one embodiment.

In FIG. 12, a flow diagram of one manufacturing procedure 1200 is shown, according to one embodiment. The method may include placing one or more cam gears onto a first object (step 1202). The method may include placing one or more drive gears onto the first object (step 1204). The method may include placing one or more cam gears onto a second object (step 1206). The method may include placing one or more drive gears onto the second object (step 1208). The method may include placing one or more cam gears onto a third object (step 1210). The method may include placing one or more drive gears onto the third object (step 1212). The method may include connecting the first object to the third object and connecting the second object to the third object (step 1214). The method may include connecting the third object to a universal adaptor (step 1216). The method may include connecting the universal adaptor to the ratchet tooth assembly (step 1218). The method may include connecting the ratchet tooth assembly to the ball pin assembly (step 1220). The method may include connecting the ball pin assembly to the cam slide (step 1222).

In one example, second cam 106A is attached to one or more securing devices 110. Further, one or more secondary drive gears 108 may also be attached to one or more securing devices 110 on second element 104A and coupled to second cam 106A. In addition third cam 106C is attached to one or more securing devices 110. Further, one or more secondary drive gears 108 may also be attached to one or more securing devices 110 on third element 104B and coupled to third cam 106C. Primary drive gear 114 may be attached to first element 116. Further first cam 106B may be attached to first element 116 and coupled to primary gear 114. Optionally, first shield 120A and second shield 120B may be attached to second element 104A and/or third element 104B, respectively. Second element 104A may be attached to first element 116 via support structure 112. Further, third element 104B may be attached to first element 116 via support structure 112. First element 116 may be attached to universal adaptor 118, ratchet tooth assembly 122, and/or power tool 902.

Figure 13:
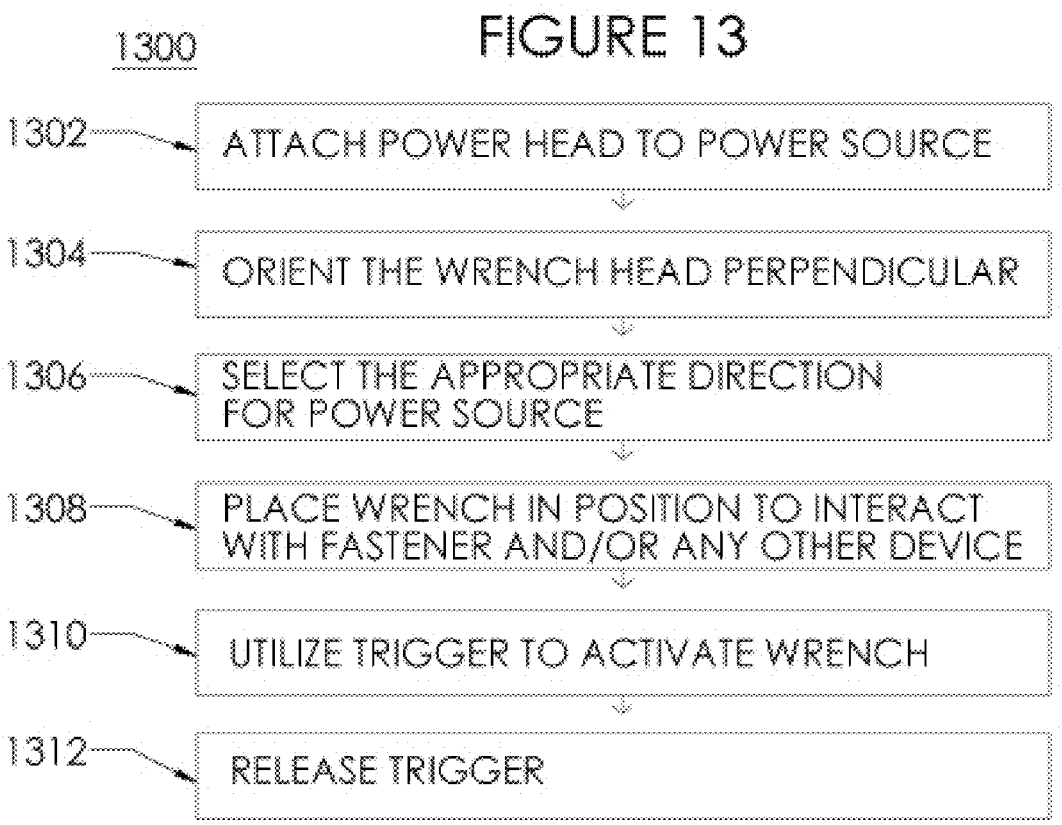
FIG. 13 is a flow diagram of one procedure for utilizing the self-adjusting and open-ended wrench, according to one embodiment.

In FIG. 13, a flow diagram of one procedure for utilizing the self-adjusting and open-ended wrench 1300 is shown, according to one embodiment. The method may include attaching the power head to a power source (step 1302). The method may include orienting the wrench head perpendicular to the fastener and/or any other device (step 1304). The method may include selecting the appropriate direction for the power source (step 1306). The method may include placing the wrench in position to interact with the fastener and/or any other device (step 1308). The method may include utilizing the trigger to activate the wrench (step 1310). The method may include releasing the trigger when the fastener and/or any other device is in the desired location (step 1312).

In one embodiment, a self-adjusting and open-ended wrench may include a drive gear assembly coupled to a power source. The drive gear assembly may include a primary drive gear located on a first element (e.g., reference number 116 from FIG. 1, the structure below reference number 116 from FIG. 1, and/or any portion thereof). The self-adjusting and open-ended wrench may include one or more secondary drive gears located on a second element (e.g., reference number 104A from FIG. 1 and/or any portion thereof). The self-adjusting and open-ended wrench may include one or more secondary drive gears located on a third element (e.g., reference number 104B from FIG. 1 and/or any portion thereof). Further, the first element may be coupled to the second element and the third element. The self-adjusting and open-ended wrench may include a cam assembly coupled to the drive gear assembly. The cam assembly may include a first cam (e.g., reference number 1068 on FIG. 1) located on the first element (e.g., reference number 116 from FIG. 1, the structure below reference number 116 from FIG. 1, and/or any portion thereof). Further, the cam assembly may include a second cam (e.g., reference number 106A on FIG. 1) located on the second element (e.g., reference number 106A from FIG. 1 and/or any portion thereof). The cam assembly may include a third cam (e.g., reference number 106C on FIG. 1) located on the third element (e.g., reference number 104B from FIG. 1 and/or any portion thereof). In addition, the first cam, the second cam, and the third cam may interact with each other to move a part (e.g., fastener, etc.).

In one example, one or more cams are made of a softer material (e.g., rubber, plastic, etc.) to be able to handle sensitive parts (e.g., electronics, plastics, etc.). In another example, one or more cams are made of a harder material (e.g., steel, iron, etc.) to be able to handle tough parts (e.g., steel fasteners, etc.). In another example, one or more cams are made of softer material and one or more cams are made of harder material at the same time. A user may select which cams to utilize based on the part being worked on. For example, when a user is working on sensitive part the user may select an option that utilizes the one or more cams made of the softer material. Then, when the user moves onto a tougher part, the user may select an option that utilizes the one or more cams made of the harder material.

In another example, the first cam may be coupled to the primary drive gear on the first element. Further, the second cam may be coupled to the one or more secondary drive gears located on the second element. In addition, the third cam may be coupled to the one or more secondary drive gears located on the third element.

In another example, the first element may be coupled to the second element via a first support structure and/or the first element may be coupled to the third element via a second support structure. In another example, the second element may shield one or more secondary drive gears (and/or any other element attach to second element and/or any other element in proximity to second element) located on the second element and/or the third element may shield one or more secondary drive gears (and/or any other element attach to third element and/or any other element in proximity to third element) located on the third element. In another example, the self-adjusting and open-ended wrench may include a first top shield element coupled to the second element and/or a second top shield element coupled to the third element.

In another example, the self-adjusting and open-ended wrench may include and/or be attached to a universal adaptor (and/or any adaptor—a first kind of adaptor may work with one or more power tools and a second kind of adaptor may work with different power tools, etc.). The self-adjusting and open-ended wrench may be coupled to the universal adaptor via the first element and/or any other element.

In another example, the second element and the third element form a portion of a closure element. Further, the second element and the third element may be configured to move towards each other.

In another example, the self-adjusting and open-ended wrench may further include and/or be attached to a ratchet tooth assembly. The ratchet tooth assembly may transfer energy from the power source to the drive gear assembly of the self-adjusting and open-ended wrench. Further, the ratchet tooth assembly may include one or more spring loaded teeth. The one or more spring loaded teeth may strike the primary drive gear of the self-adjusting and open-ended wrench to transfer energy to the drive gear assembly of the self-adjusting and open-ended wrench.

In another embodiment, an apparatus may include a drive gear assembly which may be coupled to a power source. The drive gear assembly may include a plurality of drive gears. The apparatus may include a cam assembly which may be coupled to the drive gear assembly. The cam assembly may include a first cam and a second cam. The first cam and the second cam may interact with each other to move a part.

In another example, the apparatus may further include a first leg and a second leg where the first leg and the second leg may form a V-shaped closure structure (and/or any other shaped closure—a C-shaped closure, a Y-shaped closure, a L-shaped closure, an X-shaped closure, a J-shaped closure, an O-shaped closure, a T-shaped closure, a U-shaped closure, and/or any combination thereof).

In another example, the apparatus may further include a closing lever where the closing lever may move the first leg and the second leg towards each other. In addition, any number (e.g., 1 to N) of legs may be utilized. For example, a first leg, a second leg, and a third leg may be utilized. In addition, the legs may be on different planes. In one example, a first leg and a second leg are on the same plane and clamp down on the part to be worked on. Whereas, the third leg is on a different plane (e.g., above, below, etc.) which allows the third leg to interact with the first leg and the second leg to secure the part in place. In one example, the first leg and the second leg attach to the side of the part. Whereas, the third leg attaches to the top and/or both of the part.

In another example, the closing lever may be attached to the first leg and/or the second leg. Further, the closing lever may be attached to any number (e.g., 1-N) of legs. For example, the closing lever may be attached to the first leg, the second leg, and the third leg. In another example, the closing lever may be attached to the first leg and the second leg but not the third leg. In addition, there may be more than one closing levers. For example, a first closing lever may be utilized to close the first leg and a second closing lever may be utilized to close the second leg. In addition, a first closing lever may be utilized to close the first leg and the second leg but a second closing lever may be utilized to close the third leg. Any number of legs and/or closing levers may be utilized in any combination.

In another embodiment, a wrench may include a drive gear assembly coupled to a power source. The drive gear assembly may include a plurality of gears located on at least one of a first element, a second element, and/or a third element. The first element may be coupled to the second element and the third element. The wrench may include a cam assembly which may be coupled to the drive gear assembly. The cam assembly may include a first cam, a second cam, and/or a third cam located on at least one of the first element, the second element, and/or the third element. Any number (e.g., 1-N) of drive gears, cams, and/or any other element described in this disclosure may be utilized. Therefore, one, two, three, four, five, six, seven, eight, nine, ten, one million drive gears, cams, and/or any other element described in this disclosure are disclosed but for brevity purposes are not individually described in detail. Further, in one example, at least two of the first cam, the second cam, and the third cam are configured to interact with each other to move a part. In another example, N cams are disclosed where a fraction (e.g., 2 of 3, 2 of 4, 3 of 4, 2 of 5, 3 of 5, 4 of 5, 2 of 6, 3 of 6, 4 of 6, 5 of 6, 2 of 7, etc.) of the cams interact with each other to move a part.

In another example, the wrench may further include and/or be attached to a universal adapter. In addition, the wrench may further include and/or be attached to a ratchet tooth assembly. In one example, the ratchet tooth assembly may be coupled to one or more power tools. In an example, the one or more power tools may include a power tool which has bidirectional movement where the bidirectional movement includes movements in a first direction and a second direction. In addition, the ratchet tooth assembly may cause movement in the drive gear assembly in a first movement direction based on the first direction of the power tool. Further, the ratchet tooth assembly may cause movement in the drive gear assembly in a second movement direction based on the second direction of the power tool.

In one example, the self-adjusting and open-ended wrench may have one or more identification tags. For example, a radio frequency ("RF") tag may be utilized to keep track of the location of the self-adjusting and open-ended wrench, the work performed by the self-adjusting and open-ended wrench, the utilization rate of the self-adjusting and open-ended wrench, any maintenance required, any maintenance history, and/or any other data relating to the self-adjusting and open-ended wrench. Further, the RF tag and/or a RF device may log one or more data elements and may transfer the one or more data elements to one or more devices. For example, a mobile device may receive information related to one or more self-adjusting and open-ended wrenches. In addition, the mobile device may issue commands, schedules, and/or any other signal based on the received information relating to the one or more self-adjusting and open-ended wrenches.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

In one example, a user may utilize this disclosure by attaching the wrench to a power head. Further, the power head may be attached to a power source. In this example, the user may orient the wrench head perpendicular to an appropriate sized fastener so that the cams are oriented around fastener. Further, the user may squeeze a trigger lever to activate the device (e.g., close one or more elements). In this example, the ratchet body may pivot and clamp down on one or more parts (e.g., fastener, etc.). In one example, the cams may spin in a unidirectional manor. Further, depending on the orientation (and/or the movement direction of the power tool) of the wrench to the fastener, the cams will either loosen or tighten the fastener. In this example, once the fastener is tightened or loosened to the operator's satisfaction or a device maximum, the release trigger lever may disengage and the cams may cease to rotate and the ratchet body pivots may release one or more parts (e.g., fastener, etc.). Further, the user may remove the device (e.g., wrench) from fastener and/or detach the wrench from the power source.

In another example, this disclosure presents a unique powered ratcheting wrench capable of self-adjustment to allow the wrench to insert or extract (and/or tighten and/or loosen) hexagonal headed fasteners ranging in size from ¼ inches through ⅝ inches with respective head sizes of ⅜ inches through ⅞ inches. In addition, any shape (e.g. circle, elliptical, square, etc.) for the head of the fastener may be utilized with this disclosure. Further, any head size (e.g., less than ¼ inches and/or bigger than ⅝ inches) may be utilized with this disclosure. In addition, any size may be utilized (e.g., less than ¼ inches, less than ⅜ inches, greater than ⅝ inches, greater than ⅞ inches, etc.).

This disclosure may be utilized in aviation, marine, automotive, any other industry, construction, repair, maintenance, and/or general hardware use. Further, this disclosure may be intended to allow access to hardware in difficult to reach places where the use of a standardized socket style wrench would not have access and where there is insufficient room to operate a box style wrench.

In all embodiments, the wrench is designed as both a possible attachment to existing powered ratchet bodies and/or as a full customized complete tool (e.g., self-powered tool, etc.). It may be implemented as a pneumatic tool, power tool and/or battery operated.

In another example, the wrench utilizes cams for tightening and loosing fasteners in hard to reach places. Further, this disclosure may ease the process in which tightening and loosing of fasteners occurs. Especially, in cases of insufficient space where current wrenches and ratchets fail. In another example, a power wrench may utilize gear-driven cams arranged in such a way around an open-ended pivoting wrench body as to allow the device to grasp any hexagonal fastener (and/or any other shaped fastener and/or any other shaped device) from ¼ inches to ⅝ inches and either tighten or loose it depending on the orientation of the wrench to the fastener and/or the directional movement of the power tool. As noted above, any size part may be tightened and/or loosened. Further, any shaped part may be tightened and/or loosened.

In another example, a universal, open-ended, self-adjusting, cam driven wrench head, may include a cam slide set perpendicular to a wrench body for clamping force; a wrench body to house gears and cams; multiple small gears arranged on the wrench body for transferring rotational force to cams; and/or gear-driven cams for exerting rotational force on a fastener.

In addition, the cams coupled with a gear shaft rotates while simultaneously forcing the cam slide toward the ratchet body engaging both internal clamping force onto an inserted fastener and exerting rotational force on contacting knurled cams through a number of small gears so as to facilitate loosening or tightening of the part (e.g., fastener, etc.) by contacting one, two, three, or more sides thus allowing the wrench to be applied to fastener perpendicular to the head as opposed to a socket-based device which must be placed over a fastener from a parallel approach.

In another example, the open-ended self-adjusting, ratchet drive wrench may have a cam slide which is forced toward the ratchet body which in turn drives the ratchet body pivot and ratchet body pivot mirror and their components inward upon the fastener. In another example, with knurled cams shaped and arranged in the ratchet body pivot and ratchet body pivot mirror so as to contact the fastener at one or more points (e.g., one, two, three, etc.) simultaneously on a part (e.g., hexagonal fastener, etc.) of any size (e.g., in this case between ¼ inch and ¾ inch) with sufficient internal clamping force to facilitate tightening and losing of the fastener.

In another example, the open-ended self-adjusting, ratchet drive wrench may have the knurled cams shaped and arranged in the ratchet body pivot and ratchet body pivot mirror so that when pressurized air is introduced into the air body drive the cam slide forward engaging the clamping force and/or simultaneously rotating the large bevel gear shaft and/or attached the large bevel gear which in turn rotates the bevel gear which through contacting a number of small gears turns the knurled cams in parallel thus rotating the inserted part (e.g., fastener, etc.) of any size (e.g., in this case between ¼ inch and ¾ inch) with sufficient torque to loosen and/or tighten the fastener.

Additionally, in the case of long nuts, nuts positioned several inches down the bolt or specifically the tie rod end nuts on a car, where a socket will not facilitate removal and/or tightening of the part (e.g., fastener, etc.), an open-ended hand-held tool is required such as a box wrench and/or a crescent wrench, to tighten and/or remove such fasteners, which is significantly time consuming, burdensome and more often than not a painful endeavor trying to manipulate a wrench back and forth between various sharp, often hot metallic parts in an engine compartment.

This disclosure shows an alternative head to the preexisting square socket-attachment head found on pneumatic ratchets. It is such that when assembled on and incorporated into the drive mechanism of a preexisting pneumatic ratchet (and/or other powered device), transforms the ratchet into an open-ended impact ratchet that auto-adjusts to fit fastener head sizes (e.g., in this case of ⅜ inch up to ⅞ inch) and facilitates tightening and/or removal of the part (e.g., fasteners, etc.). In one example, the wrench may be an adjustable pneumatic box wrench with an impact drive mode of operation to increase torque and efficiency. In one example, the wrench facilitates the removal and/or tightening of parts (e.g., fasteners, etc.) which are inaccessible to existing conventional pneumatic devices.

In another example, through the use of rotary torque, rotational force is applied to the large bevel gear shaft while simultaneously forcing the cam slide towards the ratchet body through application of a slip gearing arrangement. Further, as torque is applied through the mechanism two distinct actions take place: 1) The wrench body may be actuated into significant clamping force on the bolt head through direct contact with the cams; and/or 2) Rotational force may conducted through the bevel gear shaft to the bevel gear. Rotational force may be transferred directly through the bevel gear to the small gears. In another example, the rotational force may be transferred directly through the small gears to the cams. In addition, the rotational force may be transferred directly through the cams to the head of the bolt (e.g., part). Further, cessation of torque may stop all transfer of force allowing for easy removal of the wrench from the bolt. In another example, the pivoting action allowed by the wrench body may allow the mechanism to firmly grasp the heads of bolts ranging in size from 0.25 inches to a maximum of 0.625 inches. In another example, the jaws of the wrench may expand for a positive gripping force to be applied to a part (e.g., bolt, etc.).

In another example, the jaws of the wrench may be contracted to provide for positive gripping force on the part (e.g., bolt, etc.). Since this may be an attachment to a power head, there are several variations of power heads that will operate this device. These include pneumatic, electrical, battery operated and/or any new designs that may exist now and/or are developed at a later time that transfer energy. In various examples, there are several types of cams, materials and/or designs that will satisfy the requirements of this disclosure. The cams may include various knurled surfaces, textures, patterns to accommodate different size, shape and styles of parts (e.g., fasteners, etc.) and/or object not limited to fasteners. In another example, this disclosure may be utilized with an impact drive. In another example, this disclosure may not be utilized with an impact drive. The size of the device can change to accommodate larger and/or smaller parts. The materials used for every piece of the device are vast and will not be limited to any particular item. For instance, a plastic model may be made for low torque applications such as for use on models and/or electronic parts. The shapes of the parts may be redesigned to accommodate smaller and/or larger spaces. An identifying mark and/or placard may be included for tracking. The wrench and/or another device may include a reversing mechanism and switch. The wrench may include a locking mechanism. Further, a ratcheting or like mechanism may be included to tighten and lock the wrench onto a part.

In one example, the wrench may be mounted onto a standard available air ratchet body with the factory supplied ratchet mechanism removed. This may be done by simply unscrewing the existing ratchet and replacing it with the adjustable air wrench attachment. In one example, the air body provides rotational force via the application of pressurized air supply.

In one example, as high pressure air flows through the air body, two distinct actions take place: 1) Air pressure may drive the cam slide away from the wrench via the large circular end causing interaction with the ratchet body pivots are actuated into significant clamping force on the part head through direct contact with the cams; and/or 2) Rotational force may be conducted through the ball pin assembly.

In one example, as rotary force is applied to the ball pin assembly, the assembly spins on its axis. The ball pin, which is off center but concentrically, mounted spins in a larger circle inside the ratchet tooth assembly. The ball pin may be mounted so that it fits inside the back of the ratchet tooth assembly in the elliptical relief cut out. This mating relationship causes the ball pin to collide only on the left and right of the ratchet tooth assembly but not on the top or bottom. This action causes the ratchet tooth assembly to pivot back and forth at a high rate of speed and impact.

In one example, as the ratchet tooth assembly pivots, a built in single tooth (and/or multiple teeth) acts directly onto the drive gear indexing it one tooth at a time generating significant rotational and impactful force. This force may be directly transferred via gears to the cam gear assemblies giving direct rotational force to the knurled cams contained in the cam gear assembly. Further, rotational force may be transferred directly through the cams to the head of the part. In addition, cessation of torque may stop all transfer of force allowing for easy removal of the wrench from the part. In another example, the pivoting action allowed by the wrench body may allow the mechanism to firmly grasp the heads of part (e.g., in one case—bolts ranging in size from 0.25 inches to a maximum of 0.625 inches).

Reference throughout this specification to "one example," "an example," "embodiment," "further," "in addition," and/or "another example" should be considered to mean that the particular features, structures, or characteristics may be combined in one or more examples.

The parts associated with this disclosure may be made and/or formed from steel, iron, plastic, rubber, glass, paper, any other similar material, and/or any other material. In addition, one or more parts may be made from similar material and/or a variety of materials. For example, a first part may be made of steel while a second part may be made of rubber.

In one example, a cam may be a rotating or sliding piece in a mechanical linkage used especially in transforming rotary motion into linear motion or vice-versa. In another example, the cam may be a tooth, teeth, as is used to deliver power via a reciprocating (back and forth) motion in the follower, which is a lever making contact with the cam.

In another example, a cylindrical cam or barrel cam may be a cam in which the follower rides on the surface of a cylinder. In one example, the follower rides in a groove cut into the surface of a cylinder. These cams may convert rotational motion to linear motion parallel to the rotational axis of the cylinder. A cylinder may have several grooves cut into the surface and drive several followers. Cylindrical cams may provide motions that involve more than a single rotation of the cylinder and generally provide positive positioning, removing the need for a spring or other provision to keep the follower in contact with the control surface.

In another example a constant lead cam may be utilized (where the position of the follower is linear with rotation, as in a lead screw). It should be noted that any type of cam may be utilized with this disclosure.

It should be noted that this disclosure has shown non-limiting examples of the wrench. The scope of the claims should not be limited by any examples utilized in this disclosure.

The invention claimed is:

1. An apparatus comprising:

a drive gear assembly configured to be coupled to a power source, the drive gear assembly including a primary drive gear and a secondary drive gear located on a first element, one or more secondary drive gears located on a separate second element, and one or more secondary drive gears located on a separate third element, the first element being coupled to the second element and the third element; and a cam assembly coupled to the drive gear assembly, the cam assembly including a first cam located on the first element and being rotatably mounted about a pin extending through an opening of the first cam and through an opening of the secondary drive gear, a second cam located on the second element and being rotatably mounted about a pin extending through an opening of the second cam and through an opening of one of the secondary drive gears, and a third cam located on the third element and being rotatably mounted about a pin extending through an opening of the third cam and through an opening of one of the secondary drive gears, wherein the first cam and the third cam are located on separate elements configured to pivot at attachment points on or near the first element and adjust under power to a shape of a part for at least one of an insertion process and an extraction process;

wherein the first cam, the second cam, and the third cam are configured to interact with each other to move the part.

2. The apparatus of claim 1, wherein the first cam is coupled to the primary drive gear on the first element, the second cam is coupled to the one or more secondary drive gears located on the separate second element, and the third cam is coupled to the one or more secondary drive gears located on the separate third element.

3. The apparatus of claim 1, wherein the first element is coupled to the second element via a first support structure and the first element is coupled to the third element via a second, separate, support structure, wherein the first support structure and second support structure are made to pivot at or near the first element.

4. The apparatus of claim 1, wherein the second element is configured to shield the one or more secondary drive gears located on the second element and the third element is separate from the second and configured to shield the one or more secondary drive gears located on the third element.

5. The apparatus of claim 4, further including a first top shield element coupled to the second element and a second top shield element, separate from the first and coupled to the third element.

6. The apparatus of claim 1, further including a universal adaptor coupled to the first element.

7. The apparatus of claim 1, wherein the second element and the third element form a closure element, configured to pivot from attachment points at or near the first element.

8. The apparatus of claim 7, wherein the second element and the third element are configured to pivot towards each other under power, via pressure applied by a closure lever.

9. The apparatus of claim 1, further including an oscillating ratchet tooth assembly configured to transfer energy from the power source to the drive gear assembly.

10. The apparatus of claim 9, wherein the ratchet tooth assembly includes a ratchet ball coupled to a ball pin assembly.

11. The apparatus of claim 10, including one or more spring loaded teeth within the ratchet tooth assembly, the one or more spring loaded teeth configured to strike the primary drive gear to transfer energy to the drive gear assembly.

12. The apparatus of claim 1, further comprising a universal adapter.

13. The apparatus of claim 1, wherein the ball pin assembly, is configured to be coupled to one or more power tools.

14. The apparatus of claim 13, wherein the one or more power tools is connected to the ball pin assembly and has bidirectional movement, wherein the bidirectional movement includes movements in a first direction and a second direction.

15. The apparatus of claim 14, wherein the ratchet tooth assembly is configured to cause movement in the drive gear assembly in a first movement based on the first direction of the ratchet ball, determined by the first direction of the power tool and a second movement direction based on the second direction of the power tool.

16. The apparatus of claim 1, wherein at least one of the first cam, the second cam, and the third cam are knurled about their full circumference and are in a shape that allows 360-degree rotation such as, but not limited to, a curvilinear polygon.

17. The apparatus of claim 1, wherein the rotational path of the ratchet ball can be made to strike the side of the ratchet tooth assembly with more or less force to create an impact drive within the apparatus, configured to increase a torque output.

* * * * *